US007814590B2

(12) United States Patent
Powell et al.

(10) Patent No.: US 7,814,590 B2
(45) Date of Patent: Oct. 19, 2010

(54) ACCESSORY PANEL FOR DIAGNOSTIC PLATFORM, PATIENT BED AND OTHER SUPPORT SURFACES

(75) Inventors: Susan Powell, LaCenter, WA (US); Mark Hensley, Ridgefield, WA (US); Karen Ellmers, Portland, OR (US); Susan Duncan, Woodburn, OR (US)

(73) Assignee: Oregon Health & Science University, Portland, OR (US)

( * ) Notice: Subject to any disclaimer, the term of this patent is extended or adjusted under 35 U.S.C. 154(b) by 0 days.

(21) Appl. No.: 12/323,105

(22) Filed: Nov. 25, 2008

(65) Prior Publication Data

US 2010/0125950 A1 May 27, 2010

(51) Int. Cl.
*A61M 1/00* (2006.01)
*A47C 21/00* (2006.01)

(52) U.S. Cl. ..... 5/503.1; 5/658; 604/322

(58) Field of Classification Search ..... 5/503.1, 5/658, 659; 604/317, 322, 357
See application file for complete search history.

(56) References Cited

U.S. PATENT DOCUMENTS 3,345,023 A * 10/1967 Scott et al. ..... 248/95
3,534,738 A 10/1970 Huck
3,717,188 A * 2/1973 Green ..... 224/42.11
3,888,236 A 6/1975 Marx
4,085,755 A 4/1978 Burrage
4,129,909 A 12/1978 Riehl
4,773,768 A 9/1988 Leeper
5,176,665 A * 1/1993 Watanabe et al. ..... 604/317
5,337,907 A * 8/1994 McKenzie et al. ..... 211/88.01
5,370,246 A * 12/1994 Traynor ..... 211/86.01
5,375,799 A 12/1994 Rhodes
5,565,265 A * 10/1996 Rubin et al. ..... 442/92
5,581,829 A 12/1996 Lee
5,758,972 A * 6/1998 Mack et al. ..... 5/503.1
5,941,623 A 8/1999 Linehan
6,848,132 B1 2/2005 Dale
D522,750 S 6/2006 Girod
2002/0018601 A1 2/2002 Nelson
2006/0224130 A1 10/2006 Garrett

* cited by examiner

*Primary Examiner*—Fredrick Conley
(74) *Attorney, Agent, or Firm*—Schwabe, Williamson & Wyatt

(57) ABSTRACT

Embodiments herein provide a flexible accessory panel with apertures from which items may be suspended. In particular, receptacles for fluids draining from a patient may be suspended from the apertures, which are retained at a level below that of the patient, maintaining a gravitational flow. Maintaining downward flow of the draining fluids limits the backflow of draining fluid to the patient and reduces the risk of infection.

20 Claims, 4 Drawing Sheets

ACCESSORY PANEL FOR DIAGNOSTIC PLATFORM, PATIENT BED AND OTHER SUPPORT SURFACES

TECHNICAL FIELD

Embodiments herein relate to devices for securing an item such as a drainage fluid receptacle in a suitable position for a sitting or reclining patient.

BACKGROUND

Nosocomial infections in hospital patients with drainage tubes can significantly increase length of patient stay and readmission, morbidity and mortality rates in hospitals. A large percentage of these infections occur in patients with urinary tract catheters that drain passively by gravity, collecting urine in a receptacle that is placed in a location below the bladder to maintain the downward flow of fluid from the patient. Passive drains may also be used to drain fluids from other organs and body cavities. Because passive drains such as urinary catheters allow fluids to flow gravitationally rather than simply permitted in only one direction, raising the receptacle to a level at or above the level of the patient may cause backflow of the fluid to the patient. This backflow may cause discomfort to the patient, but more importantly, it may also cause the entry of pathogens into the bladder or other draining area.

Fluid backflow presents a special problem when patients are sitting or lying down, especially where the patient is lying on a surface that has not been adapted to accommodate a fluid receptacle. MRI and CT scanners, for example, frequently lack hooks or other fasteners below the patient table to accommodate drainage receptacles. In addition, hospital beds, mobility devices, and beds in the home-care patient's own home may not accommodate a drainage receptacle.

Bedrail caddies for storing the personal items of hospital patients are currently available. Such caddies are generally suspended by a loop from a bedrail and include one or more pockets to hold small personal objects. Although these devices offer convenient storage for patients, they are not suitable for securing a drainage receptacle because their location on the bedrail is slightly elevated with respect to the patient. The pockets of these caddies also do not accommodate fluid receptacles, which are usually soft-sided bags that require suspension for optimal function. Further, the available bed caddies are not suitable for storing medical instruments, which vary widely in size and shape. Finally, the available caddies require a bedrail or other similar structure, which may not be available in the patient's location.

BRIEF DESCRIPTION OF THE DRAWINGS

Embodiments herein will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
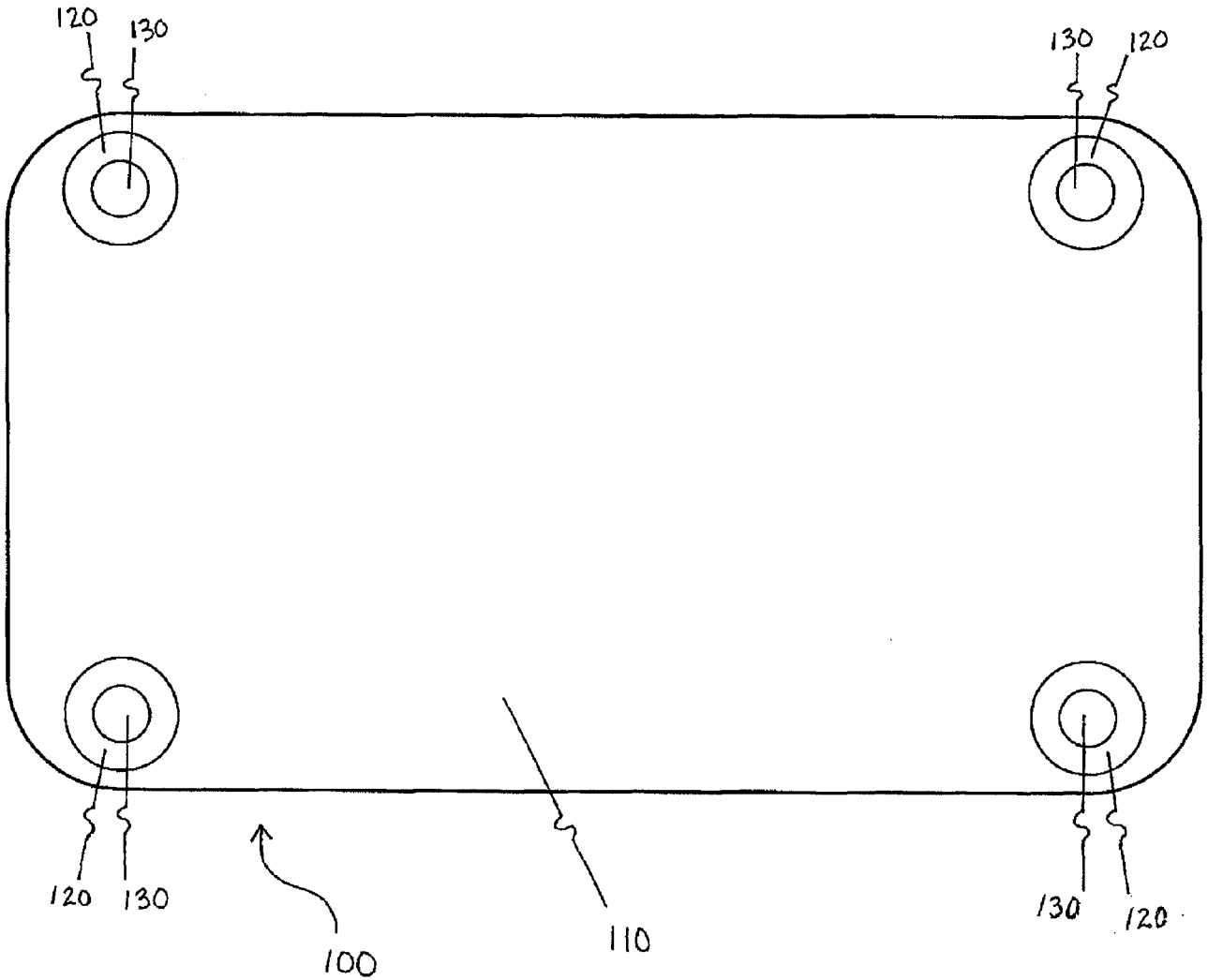
FIG. 1 illustrates an accessory panel in accordance with various embodiments.

In the following detailed description, reference is made to the accompanying drawings which form a part hereof, and in which are shown by way of illustration embodiments which may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding disclosed embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments herein.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments, are synonymous.

For the purposes of describing embodiments herein, the phrase "accessory panel" refers to any of the disclosed devices, whether adapted for use with a diagnostic platform, hospital bed or with another object/device/elevated support surface.

For the purposes of describing embodiments, the phrase "diagnostic platform" refers to a support surface or table for a patient associated with a diagnostic device, such as an MRI apparatus, CT scanner, X-ray apparatus, etc.

For the purposes of describing embodiments, the phrase "reinforcing member" refers to any hollow element open on at least two sides that is retained within an aperture of an accessory panel such that the reinforcing member and/or aperture describes an interior void through which an object may be inserted.

For the purposes of describing embodiments, the term "coupling member" refers to any substance/item used to reversibly or irreversibly bind one element/object to another element/object. The term "coupling member" includes, but is not limited to, hook-and-loop fasteners, snaps, buttons, clips, tape, glue, synthetic adhesives, natural adhesives, contact adhesives, drying adhesives, thermoplastic adhesives, resins, and others.

Embodiments herein provide an accessory panel including one or more reinforced apertures from which instruments, fluid receptacles or other items may be suspended. An accessory panel in accordance with an embodiment may be placed below a patient, a mattress, a cushion, a long spine board, a stretcher or another elevated support surface upon which a patient may sit or recline, or may be used with a wheelchair or other mobility device, any of which may be reversibly or irreversibly coupled with an accessory panel. Devices in accordance with embodiments herein may be used on any suitable support surface.

An embodiment provides an accessory panel for suspending items below the level of a sitting or reclining patient, the device comprised of at least one flexible panel and at least one aperture. In an embodiment, suspending an item below the level of a reclining person refers to suspending an item at or below the upper surface level of a diagnostic platform, bed, mattress, etc. In an embodiment, suspending an item below the level of a sitting person refers to suspending an item at or below the surface level of the seat. In an embodiment, positioning an aperture away from the transverse midline of the device (i.e., near a long end of the device) ensures that when the device is placed on a suitable elevated surface, such as an elevated portion of a bed or chair, with the portion of the device bearing the aperture hanging downward over the edge of the elevated surface, the aperture is positioned at a lower level than the patient resting on the surface.

In an embodiment, there is provided a mechanism for retaining fluid receptacles, medical instruments and/or other items conveniently near the patient for whom they will be used. While some fluid receptacles (such as those retaining intravenous fluids) are designed for the gravitational flow of fluids into a patient, requiring elevation of the receptacle, others are designed for retaining fluids draining from a patient. For best function, these receptacles should be placed below the level of the patient's body in order to maintain flow from the patient to the receptacle and prevent backflow to the patient. In addition, these receptacles should generally remain within a limited distance from the patient due to the length of the hose or tube connecting the receptacle to the patient. Embodiments provide a device from which a fluid receptacle or other object may be hung near the patient but below the level of at least some portion of the patient's body. Embodiments also provide a device for suspending objects including, but not limited to, a medical instrument, a clipboard, a chart or other information, a monitor/sensor, a hose/tube, a bag, and a hook/clasp/fastener.

Some embodiments include an aperture reinforced with a grommet, eyelet, ring, placket or other similar feature.

Embodiments may include two or more panels or sections coupled by various elements such as an elastic band, a strap, an adhesive, a hinge, an additional panel, a seam, a weld, a rivet or other fastener.

Elements of the device may be constructed from any suitable material including, but not limited to, paper, polymer, plastic, polyester, silicone, rubber, resin, nylon, cloth, metal, ceramic, or a combination of any of such materials. Devices according to various embodiments may be disposable, biodegradable, and/or adapted for incineration after use.

In an embodiment, one or more elements of the device may be constructed of a radiotransparent material such that the material does not interfere with medical imaging of the patient. In some embodiments one or more elements of the device may be coated with an antimicrobial substance and/or composed at least in part of an antimicrobial material. Devices in accordance with various embodiments may be heat-resistant and may be sterilized in an autoclave without loss of function. In an embodiment, one or more elements of the device may be water-resistant and/or water-repellent. In some embodiments, a device may be adapted to remain in place on a surface through the use of a coupling member, such as an adhesive or a fastener, or a non-skid/non-slip coating, or the device may be constructed at least partially of non-skid/non-slip materials.

Devices in accordance with various embodiments may vary in thickness, length and width in order to accommodate various environmental and usage conditions. For example, in some embodiments the length of a device adapted for use with a diagnostic platform or hospital bed may be greater than the length of another device designed for wheelchair use, due to the difference in the widths of the elevated surfaces upon which the devices are placed.

FIG. 1 illustrates a plan view of an accessory panel 100 in accordance with various embodiments. In the illustrated embodiment, a flexible panel 110 includes apertures 130 that extend through the thickness of the flexible panel 110. Apertures 130 are located near the periphery of panel 110 providing suitable access to apertures 130 when accessory panel 100 is in use on a support surface. Within each aperture 130 there is a reinforcing member 120. In this embodiment, reinforcing member 120 is a narrow hollow cylinder coupled to, and encircled around its exterior edges by, a flange in contact around its circumference with the top surface of the flexible panel and a flange in contact around its circumference with the bottom surface of the flexible panel.

In operation, the accessory panel illustrated in FIG. 1 may be placed on an elevated surface (for example, the top surface of a diagnostic platform or hospital bed frame) and oriented such that at least one end of the device extends beyond an edge of the elevated surface. In various embodiments the flexibility of the flexible panel may allow the portion of the device extending beyond the edge of the surface to drape or hang over the edge, substantially perpendicularly to the elevated surface and/or to the surface of the ground/floor, and with an aperture retained at or below the elevated surface. Fluid receptacles, instruments, tubes/hoses, patient charts/information and other objects may then be suspended from the aperture using a hook or other fastener.

In an embodiment, a strap may be added to a top or bottom surface of the flexible panel and may be used to fasten/secure the device to the elevated surface. Fastening the device with a strap may be accomplished by passing the strap below the elevated surface, attaching the strap to another part of the device and/or to the elevated surface, and/or passing the strap through an aperture. A device in accordance with various embodiments may be coupled to the elevated surface or may be retained on the surface by placing an object or weight onto the device, such as a mattress, a bed, a cushion, a pad, a platform, a patient, a long spine board, a stretcher, a patient transport device, or another object.

Embodiments may include 1, 2, 3, 4, 5, 6, 7, 8 or more apertures/reinforcing members. In various embodiments a reinforcing member may be held in place by one or more flanges, edges, rims, ridges, ribs, or collars, and/or by an adhesive applied between the reinforcing member and a surface of an aperture and/or flexible panel. A reinforcing member may be constructed as a single piece or as 2, 3, 4, 5, 6 or more pieces. Some embodiments may lack a reinforcing member. In embodiments, the shape of a reinforcing member may vary and may be irregular, oval, triangular, square, rectangular, pentagonal, hexagonal, heptagonal, octagonal, or any other suitable shape. A reinforcing member may be continuous or discontinuous within an aperture. In an embodiment, a reinforcing member may include a placket that at least partially surrounds an aperture on the front and/or back surface of the panel but does not occlude the aperture.

Figure 2:
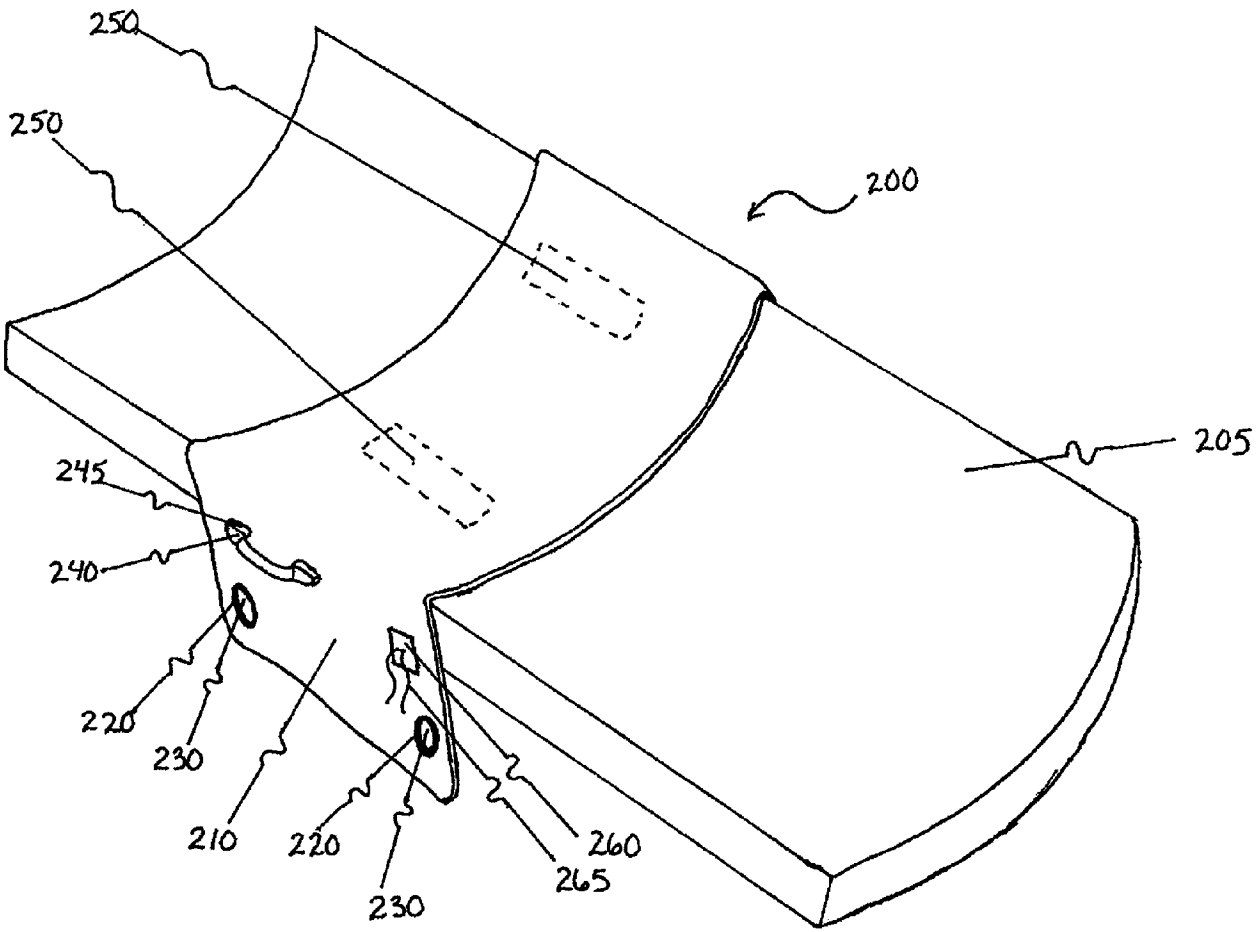
FIG. 2 illustrates an accessory panel secured to a base in accordance with various embodiments.

FIG. 2 illustrates a perspective view of an accessory panel 200 placed over an elevated surface in accordance with various embodiments. A flexible panel 210 including apertures 230 may be placed over a surface and secured to the surface by coupling members 250. Within each aperture 230 there is provided a reinforcing member 220. Pads 245 are coupled to a surface of the flexible panel 210 and to a retaining strap 240, connecting the retaining strap 240 to the flexible panel 210. Pads 245 may provide a reversible coupling with retaining strap 240 through an adhesive, hook-and-loop fastener, etc. A placket 260 coupled to a surface of the flexible panel 210 retains a tie element 265.

In the operation of this embodiment, the flexible panel 210 may be placed on the surface 205 and secured with coupling members 250. Fluid receptacles, instruments and other objects may be suspended from apertures 230 and/or reinforcing members 220. Tubes, instruments or other items may be retained against the flexible panel 210 by tying them with a tie element 265 and/or by placing them between retaining strap 240 and flexible panel 210.

In embodiments, a retaining strap and/or tie element may be reversibly or irreversibly coupled to a flexible panel. A tie element may include two or more long, narrow strips of material adapted to be tied together, and may vary in length, width, thickness and composition. A retaining strap may include one or more strips of material and may also vary in length, width, thickness and composition. Embodiments may include any number or combination of adhesive elements and/or tie elements.

Figure 3:
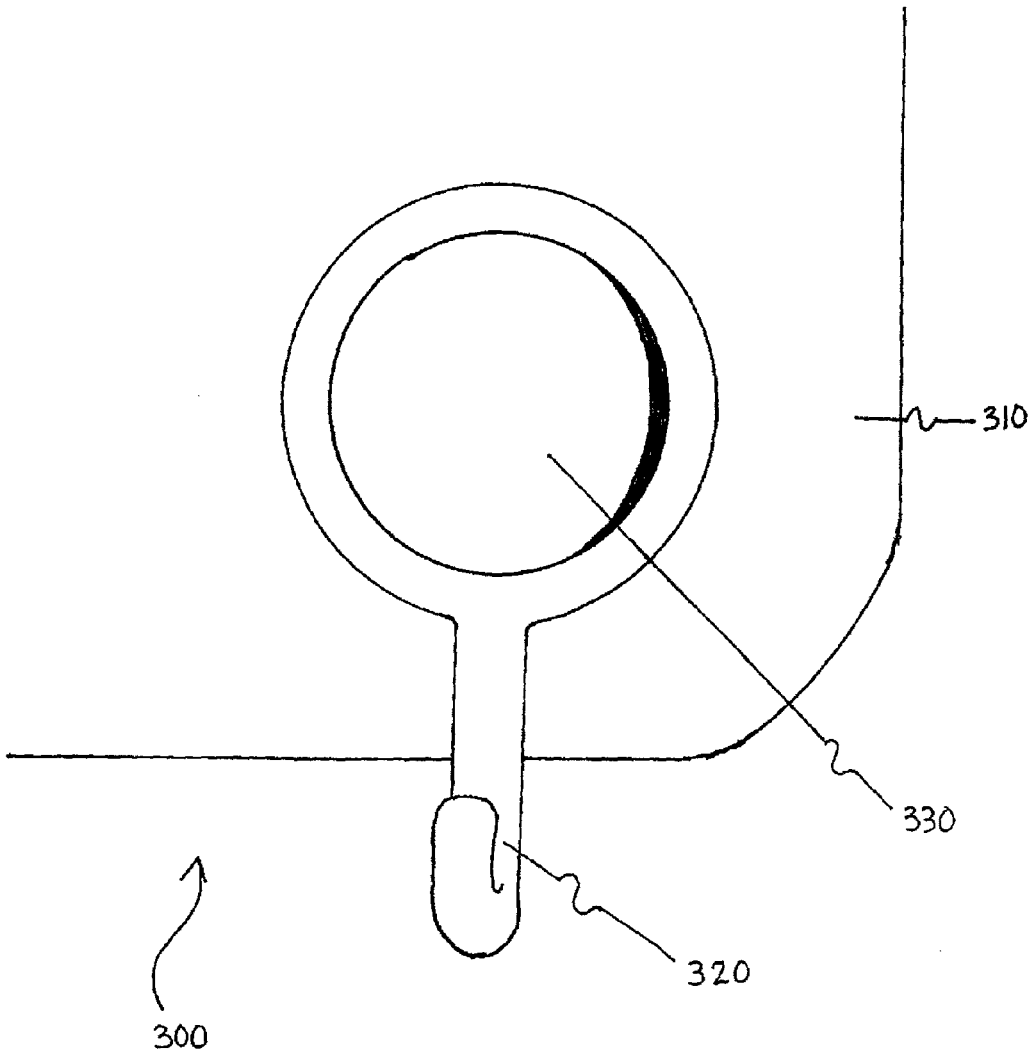
FIG. 3 illustrates an accessory panel grommet with a hook in accordance with various embodiments.

FIG. 3 illustrates a section of an accessory panel 300 including as a reinforcing member a grommet hook 320 in accordance with various embodiments. The term "grommet hook" refers to a reinforcing member with an integrated hook. In the illustrated embodiment, a grommet hook 320 fits within an aperture 330 in a flexible panel 310. In embodiments, a grommet or other reinforcing member may be retained within a flexible panel as described above. In some embodiments, a grommet or other reinforcing member may be shaped to accommodate a particular instrument or object. For example, in an embodiment a grommet may include a rigid ring structure retained at substantially a right angle to the flexible sheet to accommodate cylindrical instruments and/or a tube. In another embodiment, a grommet or other reinforcing member may be shaped to accommodate a strap or other element of the device. Some embodiments may lack a grommet or other reinforcing member, while other embodiments include an eyelet, a ring and/or another type of reinforcing member.

Figure 4:
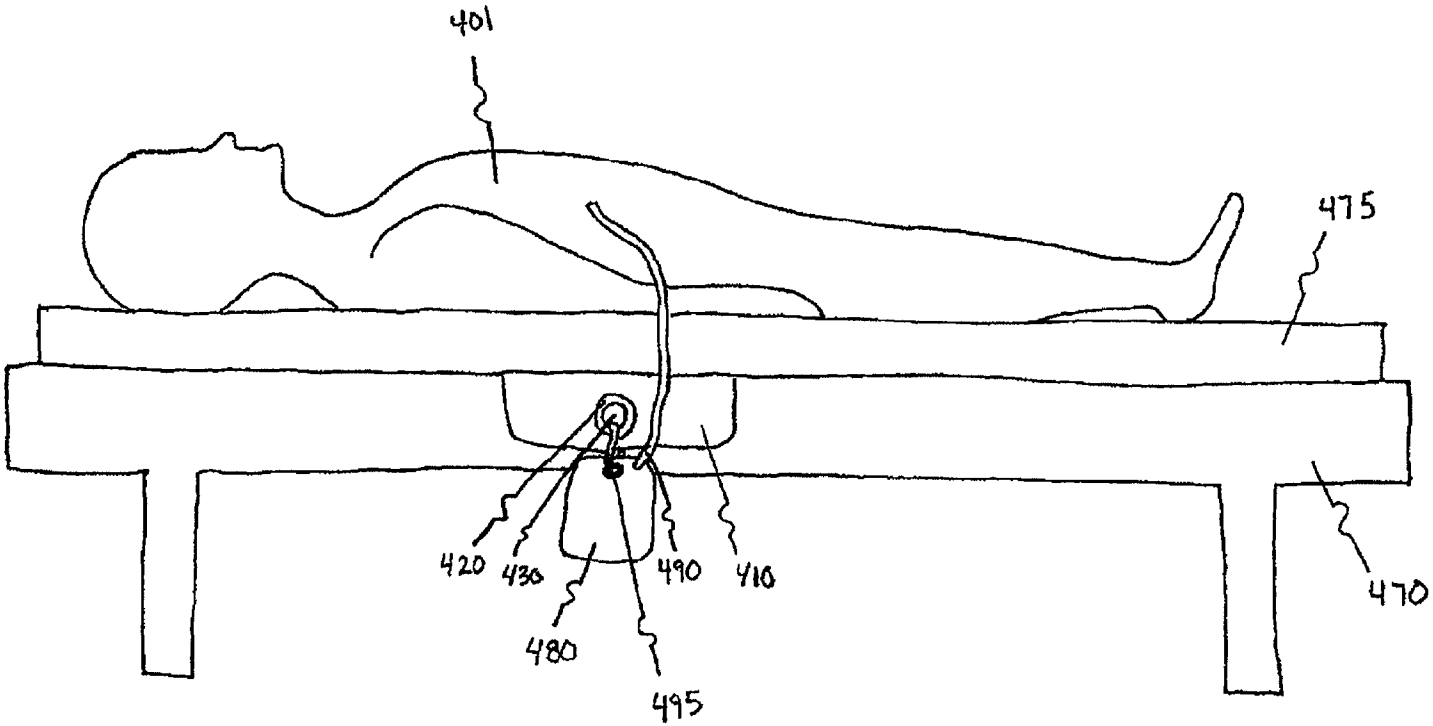
FIG. 4 illustrates an accessory panel in use with a fluid receptacle hanging therefrom in accordance with various embodiments.

FIG. 4 illustrates an accessory panel in use with a fluid receptacle hanging therefrom in accordance with various embodiments. In the illustrated embodiment, a patient 401 is shown reclining on a mattress 475 that is supported by a bed frame 470. A flexible panel 410 is positioned between the bottom surface of mattress 475 and the upper surface of bed frame 470 to allow a portion of flexible panel 410 to drape downward over the edge of bed frame 470. An aperture 430 within the downward draping portion of flexible panel 410 is retained below mattress 475, the upper surface of bed frame 470 and patient 401. A reinforcing member 420 fits within aperture 430 in flexible panel 410. One end of a hook 495 is disposed through aperture 430 and another end of hook 495 is disposed through an opening in fluid receptacle 480, suspending fluid receptacle 480 from aperture 430. A drainage tube 490 extends from patient 401 to fluid receptacle 480, allowing fluids to drain gravitationally from patient 401 into fluid receptacle 480.

Some embodiments may lack an integrated or independent hook. Other embodiments may include an integrated or independent clasp, clip, or other fastening mechanism to hold a fluid receptacle, an instrument, a tube, a patient chart and/or another object. In various embodiments lacking a hook or other such mechanism, a fluid receptacle may include a hook and/or another suspension mechanism that may be placed through one, two or more apertures to suspend the fluid receptacle from the accessory panel.

In various embodiments, a drainage tube may extend from various organs, limbs, and/or the trunk of a patient. For example, a drainage tube may extend from a patient's bladder, a patient's chest, a surgical wound, or another area.

While the embodiment of FIG. 4 is shown with respect to a hospital bed, devices herein may be used with diagnostic platforms (MRI devices, CT scanners, etc.) as well as on transport surfaces and other patient supports.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A method for securing a fluid receptacle below a support surface, comprising:

positioning a pliable panel onto the support surface with a middle portion of the pliable panel disposed horizontally along, and supported by, an upper surface of the support surface, and a distal portion of the pliable panel hanging downwardly over an edge of the support surface in a substantially vertical position, the pliable panel being devoid of pockets and the distal portion including at least one aperture coupled to a reinforcing member retained within the aperture, the reinforcing member having a hole open on at least two sides and extending through the thickness of the pliable panel; and coupling a fluid receptacle to the reinforcing member, wherein the fluid receptacle is retained below the upper surface of the support surface.

2. The method of claim 1, wherein at least one of the pliable panel and the reinforcing member is radiotransparent.

3. The method of claim 1, further comprising placing a second support surface onto the middle portion of the pliable panel, with the middle portion of the pliable panel disposed between the support surface and the second support surface, wherein the second support surface comprises a compressible material.

4. The method of claim 1, wherein the support surface is configured to support a sitting or recumbent body in an elevated position.

5. The method of claim 1, wherein the pliable panel is a continuous sheet of a pliable material.

6. The method of claim 1, the pliable panel further comprising a coupling member disposed on a bottom surface of the pliable panel, and the method further including coupling the coupling member to the upper surface of the support surface.

7. The method of claim 6, wherein the coupling member comprises a portion of a hook-and-loop fastener, and coupling the coupling member to the upper surface comprises placing said portion against a corresponding portion of the hook-and-loop fastener on the upper surface of the support surface.

8. The method of claim 1, wherein the support surface is a mattress, a cushion, a long spine board, a stretcher, a chair seat, a diagnostic platform, or a generally horizontal surface configured to support a mattress, cushion, long spine board, stretcher, chair seat, or diagnostic platform.

9. The method of claim 1, the pliable panel further comprising a retaining strap coupled to a surface of the pliable panel and a drainage tube coupled to the drainage receptacle, the method further including coupling the retaining strap to the drainage tube.

10. The method of claim 1, the pliable panel further comprising a tie element coupled to the outer surface of the pliable panel and a drainage tube coupled to the drainage receptacle, the method further including coupling the tie element to the drainage tube.

11. A device for securing a fluid container below a support surface, comprising:

a pliable radiotransparent panel comprising a continuous sheet of material devoid of pockets and having a top surface and a bottom surface, the pliable radiotransparent panel having at least a middle portion and two distal portions, the two distal portions disposed at the longitudinal ends of the pliable radiotransparent panel, the middle portion configured to be retained in a substantially horizontal position on the top of the support surface with the distal portions extending beyond the lateral edges of the top of the support surface and hanging downward in a substantially vertical position, each of the two distal portions including at least one aperture extending through the thickness of the continuous sheet from the top surface to the bottom surface; and a radiotransparent grommet disposed within each aperture and extending through the thickness of the continuous sheet, the radiotransparent grommet describing a hole open on at least two sides, wherein the radiotransparent grommet is configured to support the fluid container below the hole.

12. A system for collecting fluids draining from above a support surface, comprising:

a support surface configured to support a portion of a body, the support surface having a top and at least one side;

a pliable panel having a top surface, a bottom surface, a middle portion and a first distal portion, the first distal portion including at least one aperture extending through the thickness of the pliable panel from the top surface of the first distal portion to the bottom surface of the first distal portion, the middle portion of the pliable panel retained in a substantially horizontal position on, and supported by, the top of the support surface with the first distal portion extending beyond an edge of the support surface and hanging downward in a substantially vertical position along the at least one side;

a reinforcing member having a hole open on at least two sides, the reinforcing member being retained within the aperture and extending through the thickness of the pliable panel from the top surface to the bottom surface;

a fluid receptacle coupled to the reinforcing member and disposed below the support surface, the fluid receptacle configured to retain fluids; and a drainage tube coupled to the fluid receptacle, the drainage tube configured to allow gravitational flow of the fluid from above the support surface into the fluid receptacle.

13. The system of claim 12, further including a coupling member coupling the fluid receptacle to the reinforcing member.

14. The system of claim 13, wherein the coupling member comprises a first end and a second end, and wherein the first end is disposed through the hole and the second end is coupled to the fluid receptacle.

15. The system of claim 12, the radiotransparent grommet further comprising a hook.

16. The system of claim 12, wherein the pliable panel is constructed of at least one of paper, polymer, plastic, polyester, silicone, rubber, resin, nylon, cloth, metal, and ceramic.

17. The system of claim 12, wherein the pliable panel comprises a material with antimicrobial properties.

18. The system of claim 12, wherein the pliable panel is coated at least in part with an antimicrobial substance.

19. The system of claim 12, wherein the pliable panel is a continuous sheet of material.

20. The system of claim 12, further including a second support surface disposed over the pliable panel, the second support surface comprising a compressible material, and the pliable panel being positioned between the support surface and the second support surface.

* * * * *